US008772657B2

(12) United States Patent
Shimoda et al.

(10) Patent No.: US 8,772,657 B2
(45) Date of Patent: Jul. 8, 2014

(54) ACCELERATION SWITCH AND ELECTRONIC DEVICE

(71) Applicants: Seiko Instruments Inc., Chiba (JP); Kazuo Toda, Fukushima (JP)

(72) Inventors: Sadashi Shimoda, Chiba (JP); Kazuo Toda, Fukushima (JP)

(73) Assignees: Seiko Instruments Inc. (JP); Kazuo Toda (JP)

( * ) Notice: Subject to any disclaimer, the term of this patent is extended or adjusted under 35 U.S.C. 154(b) by 0 days.

(21) Appl. No.: 13/755,581

(22) Filed: Jan. 31, 2013

(65) Prior Publication Data

US 2013/0207485 A1 Aug. 15, 2013

(30) Foreign Application Priority Data

Feb. 9, 2012 (JP) ..... 2012-025723

(51) Int. Cl.
*H01H 35/02* (2006.01)

(52) U.S. Cl.
USPC ..... 200/61.45 R

(58) Field of Classification Search
USPC ..... 200/61.45 R, 61.46, 61.52, 61.53, 61.55; 307/121; 350/669
See application file for complete search history.

(56) References Cited

U.S. PATENT DOCUMENTS

| | | | | | |
|---|---|---|---|---|---|
| 2,503,950 | A * | 4/1950 | Johnson | ..... | 200/80 R |
| 5,450,049 | A * | 9/1995 | Bachmann | ..... | 335/205 |
| 6,018,130 | A * | 1/2000 | Haack et al. | ..... | 200/61.52 |
| 2012/0305370 | A1 * | 12/2012 | Shimoda | ..... | 200/61.45 R |

FOREIGN PATENT DOCUMENTS

| | | | | | |
|---|---|---|---|---|---|
| JP | 09145740 | | 6/1997 | | |
| JP | 2010014532 | A * | 1/2010 | ..... | H01H 35/14 |

* cited by examiner

*Primary Examiner* — Edwin A. Leon
(74) *Attorney, Agent, or Firm* — Adams & Wilks

(57) ABSTRACT

An acceleration switch has a frame fixed to a first substrate, a beam positioned inside the frame and supported by the frame, and a mass body supported by the beam and having a hole portion at substantially a center thereof. A central body is positioned inside the hole portion and fixed to the first substrate. The hole portion or the central body are suitably configured, or the position of the hole portion or the position of the center body is suitably selected, so that the acceleration switch is capable of detecting a predetermined acceleration irrespective of the influence of gravity acceleration.

20 Claims, 5 Drawing Sheets

ACCELERATION SWITCH AND ELECTRONIC DEVICE

BACKGROUND OF THE INVENTION

1. Field of the Invention

The present invention relates to an acceleration switch and an electronic device.

2. Description of the Related Art

As a conventional acceleration switch, there is used an omnidirectional acceleration switch as described in Japanese Patent Application Laid-open No. Hei 09-145740, in which a counter electrode (central body) is provided inside a mass body and the mass body is supported by a beam. Such an acceleration switch is described below with reference to FIG. 1.

FIG. 1 is a cross-sectional view of the conventional acceleration switch. This acceleration switch 001 includes a peripheral portion (frame) 101, a beam 102, a mass body (weight) 103, and a counter electrode 104. One end of the beam 102 is fixed to the mass body 103 and the other end of the beam 102 is fixed to the peripheral portion 101. In this manner, the peripheral portion 101 supports the mass body 103 with the use of the beam 102.

In accordance with acceleration applied to the acceleration switch 001, the mass body 103 and the counter electrode 104 disposed inside the mass body 103 are brought into contact with each other. In this manner, an external device connected to the acceleration switch 001 detects vibration. In other words, when acceleration is applied to the acceleration switch 001, the mass body 103 moves to contact with the counter electrode 104, and the acceleration switch is turned ON. This acceleration switch has various advantages such as being available as a normally-off and omnidirectional switch and being relatively compact and mass-producible because monocrystalline silicon can be used as a base for production with the use of semiconductor manufacturing technology.

An acceleration switch to be mounted on an electronic device is highly required to be more compact, and hence a smaller external dimension of the acceleration switch is more advantageous. Cost of the acceleration switch is also highly required to be lower, and it is therefore further advantageous to use the semiconductor manufacturing technology to reduce the external dimension of the acceleration switch and thereby produce a large number of acceleration switches on a single wafer.

However, this is effective when the acceleration switch is placed horizontally, but the omnidirectional sensitivity is not effective depending on the usage of the acceleration switch, and a predetermined sensitivity may not be obtained.

For example, it is supposed that the acceleration switch is held perpendicularly (in the vertical direction) with respect to a horizontal plane (including a plane perpendicular to the vertical direction, a substantially horizontal plane, and a plane equivalent thereto). In the case where the acceleration switch is produced to have a sensitivity of, for example, 1 G or less, the switch becomes the ON state in response to the gravity of 1 G. FIG. 2A illustrates the case where the acceleration switch is held in parallel to the horizontal plane. FIG. 2B illustrates the case where the acceleration switch is held perpendicularly to the horizontal plane. In FIG. 2A, the horizontal plane is the XY plane, and the direction of gravity is the Z direction. In FIG. 2B, the horizontal plane is the XZ plane, and the direction of gravity is the Y direction (to be exact, the −Y direction). In the case where the acceleration switch is produced to have a sensitivity of 1 G or less, such as 1 G, when the switch is turned upright, the switch becomes the ON state because the gravity acceleration of 1 G has already been applied.

A specific description is now given. In the following, for simplification, a mass body and a counter electrode corresponding to the mass body 103 and the counter electrode 104 are only illustrated. In FIGS. 2A and 2B, the line AA' represents a center line of a counter electrode 202 in the X direction (second direction), the line BB' represents a center line of a mass body 201 in the X direction, and the line CC' represents center lines of the counter electrode 202 and the mass body 201 in the Y direction (first direction) orthogonal to the thickness direction of a first substrate to be described later. The direction of gravity (vertical direction) in FIG. 2A is the Z direction, and the direction of gravity in FIG. 2B is the Y direction. Note that, in FIG. 2A, the line AA' and the line BB' are aligned with each other.

FIGS. 2A and 2B illustrate the case of an acceleration switch 002 having a sensitivity of, for example, 1 G. FIG. 2A illustrates the case where the acceleration switch 002 is placed horizontally. A distance "a" as an electrode interval between the counter electrode 202 and the mass body 201 is equal to a distance by which the mass body 201 displaces when an acceleration of 1 G is applied to the acceleration switch 002. Note that, a gap between the counter electrode 202 and the mass body 201 is uniformly the same as the distance "a" on the whole circumference. In this case, when the acceleration switch 002 is turned upright with respect to the horizontal plane, the mass body 201 displaces in the direction of gravity (vertical direction) in response to the gravity of 1 G.

As illustrated in FIG. 2B, the counter electrode 202 is brought into contact with a side wall of a through hole (hole portion) 205 on the C side, with the Y direction being the direction of gravity (vertical direction). The displacement amount in response to 1 G is equal to the distance "a" between the electrode of the mass body 201 and the counter electrode 202, and hence the mass body 201 is brought into contact with the counter electrode 202. In other words, the conventional technology has a problem in that a predetermined acceleration cannot be detected when acceleration other than an acceleration intended to be detected, such as the gravity acceleration, is applied. Note that, the electrodes to be electrically conductive by this contact are formed on opposing side walls of the mass body 201 and the counter electrode 202.

SUMMARY OF THE INVENTION

It is therefore an object of the present invention to improve the above-mentioned acceleration switch so that a predetermined acceleration can be detected even when acceleration other than an acceleration intended to be detected, such as the gravity acceleration, is applied.

In order to solve these problems, an acceleration switch of the present invention is configured as follows.

According to an exemplary embodiment of the present invention, there is provided an acceleration switch, including: a first substrate made of an insulating material; a frame fixed to the first substrate; a beam which is positioned inside the frame and is supported by the frame; a mass body which is supported by the beam and has a hole portion at substantially a center thereof; and a central body which is positioned inside the hole portion and is fixed to the first substrate, in which, under a state where the first substrate is placed substantially horizontally, center positions of at least one of a combination of the mass body and the hole portion, a combination of the mass body and the central body, and a combination of the hole portion and the central body are not aligned with each other in a first direction.

The acceleration switch according to the exemplary embodiment of the present invention further includes a second substrate which is positioned on an opposite side of the first substrate and is made of an insulating material, and the frame and the central body are fixed to the second substrate.

Further, in the acceleration switch according to the exemplary embodiment of the present invention, the second substrate includes: a first through electrode for electrically connecting the frame and an external circuit to each other; and a second through electrode for electrically connecting the central body and the external circuit to each other.

Further, in the acceleration switch according to the exemplary embodiment of the present invention, the beam is a single beam.

Further, in the acceleration switch according to the exemplary embodiment of the present invention, the beam is an arc-like beam.

Further, in the acceleration switch according to the exemplary embodiment of the present invention, a distance between a side surface of the hole portion and a side surface of the central body is 1 μm or more and 20 μm or less.

Further, in the acceleration switch according to the exemplary embodiment of the present invention, the hole portion includes: a straight portion which is parallel to the first direction; and an arc portion which warps with respect to a second direction orthogonal to the first direction and a thickness direction.

According to an exemplary embodiment of the present invention, there is provided an electronic device, including: the above-mentioned acceleration switch; and a circuit for detecting a detection signal output from the acceleration switch to perform a predetermined operation in accordance with the detection signal.

According to the present invention, a predetermined acceleration intended to be detected can be detected even when another acceleration than the acceleration intended to be detected is applied.

With this configuration, when the acceleration switch is mounted in, for example, an electronic device which can incorporate only a small capacity battery to save power, the device can stop its operation when a human vibration is not detected, that is, when the device is not used, and the device can automatically start its operation upon detection of vibration, that is, when the device is used. Thus, it is possible to realize an electronic device in which the wasted use of a battery is avoided.

DETAILED DESCRIPTION OF THE PREFERRED EMBODIMENTS

Referring to the accompanying drawings, exemplary embodiments of the present invention are described below.

(First Embodiment)

Figure 2A:
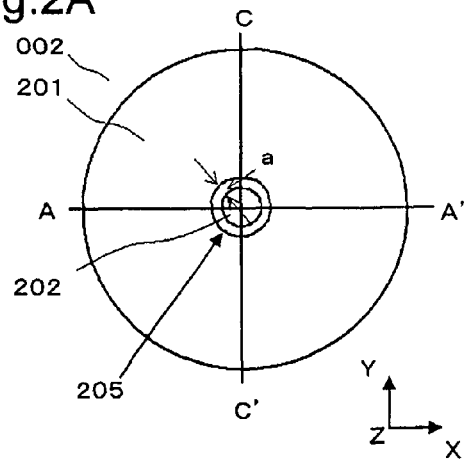
PRIOR ART Fig.2A
FIGS. 2A and 2B are front views illustrating an operation of the conventionally known acceleration switch.
Figure 2B:
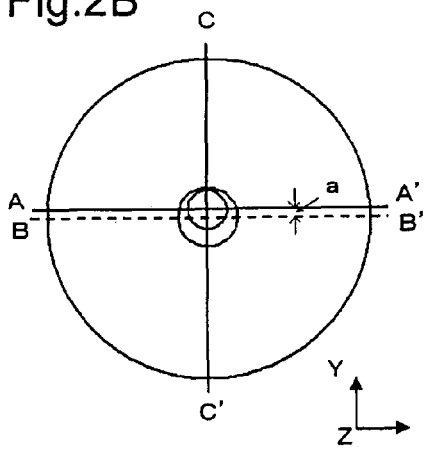
PRIOR ART Fig.2B

As described in the description of the related art illustrated in FIGS. 2A and 2B, in the case where the acceleration switch 002 is turned upright with respect to the horizontal plane, as long as the distance between the mass body 201 and the counter electrode 202 is sufficiently large so that the mass body 201 and the counter electrode 202 may not contact with each other, the mass body 201 and the counter electrode 202 are prevented from contacting with each other even when the acceleration switch 002 is turned upright with respect to the horizontal plane. The details of a first embodiment of the present invention are described below with reference to FIGS. 3A to 3D.

Figure 3A:
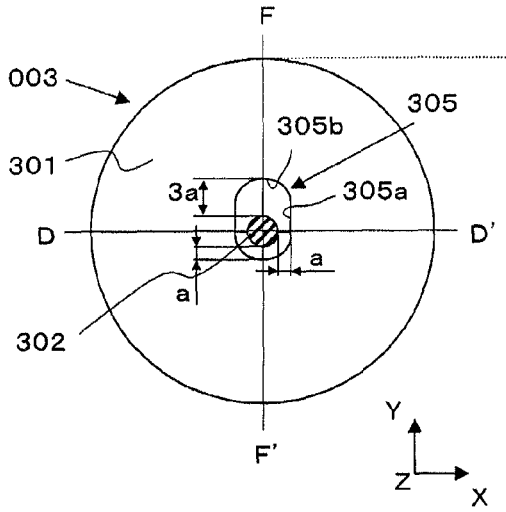
FIGS. 3A to 3D are front views illustrating an operation of an acceleration switch according to a first embodiment of the present invention.
Figure 3B:
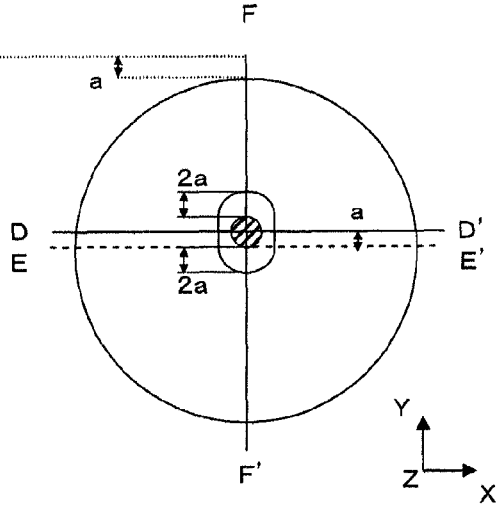

In FIGS. 3A to 3D, the line DD' represents a center line of a counter electrode 302 in the X direction (second direction), the line EE' represents a center line of a mass body 301 in the X direction, and the line FF' represents center lines of the counter electrode 302 and the mass body 301 in the Y direction (first direction). In FIG. 3A, the horizontal plane is the XY plane, and the direction of gravity (vertical direction) is the Z direction. In FIG. 3B, the horizontal plane is the XZ plane, and the direction of gravity is the Y direction. Note that, in FIG. 3A, the line DD' and the line EE' are aligned with each other.

FIG. 3A illustrates the case where an acceleration switch 003 is placed horizontally, in which the distance between the mass body 301 and the counter electrode 302 is sufficiently large in the Y direction of FIG. 3A. A distance between an electrode of the mass body 301 and the counter electrode 302 on the F side is represented by "3*a*". When the acceleration switch 003 is turned upright with respect to the horizontal plane, because "a" corresponds to 1 G, the mass body 301 displaces by the distance "a" in response to the gravity of 1 G applied to the acceleration switch 003. Thus, the distance between the mass body 301 and the counter electrode 302 becomes "2*a*", which is the difference between "3*a*" and "a". This state is illustrated in FIG. 3B. In this manner, even when the acceleration switch 003 is turned upright with respect to the horizontal plane, the acceleration switch 003 can maintain a sensitivity of 2 G in the Y direction and a sensitivity of 1 G in the X direction of FIG. 3B, though the sensitivity is improved in one direction (Y direction of FIG. 3B).

In other words, under the state where a first substrate to be described later is placed substantially horizontally in FIG. 3A, the center of the through hole 305 is shifted from the center of the mass body 301 to the F side by the distance "a", and hence the counter electrode 302 is decentered. That is, the acceleration switch of FIG. 3A has a shape in which the centers of the mass body 301 and the counter electrode 302 are aligned and coincide with each other, but the centers of the mass body 301 and the counter electrode (central body) 302 do not coincide with and are shifted from the center of the through hole (hole portion) 305 by the distance "a".

In other words, under the state where a first substrate to be described later is placed substantially horizontally in FIG. 3A, the center of the through hole 305 is shifted from the center of the mass body 301 to the F side by the distance "a", and hence the counter electrode 302 is decentered. That is, the acceleration switch of FIG. 3A has a shape in which the centers of the mass body 301 and the counter electrode 302 are aligned with each other, but the centers of the mass body 301 and the counter electrode (central body) 302 are shifted from the center of the through hole (hole portion) 305 by the distance "a".

In this embodiment, the thorough hole 305 of the mass body 302 is formed of the straight portion 305*a* and the arc portion 305*b*, but the thorough hole 305 may have an oval shape formed by an arc portion as a whole. The oval shape in this case can have the minor direction corresponding to the second direction and the major direction corresponding to the first direction.

(Modified Example of First Embodiment)

Figure 3C:
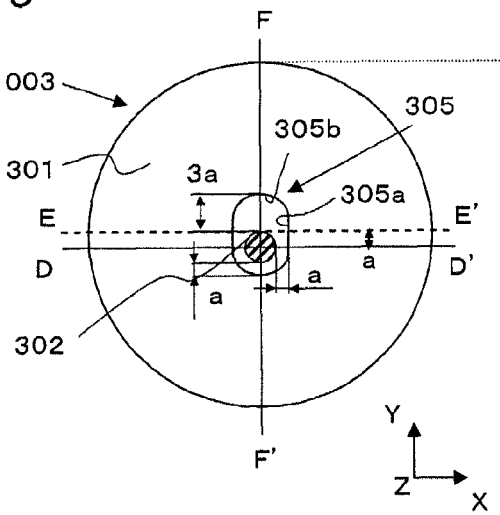
Figure 3D:
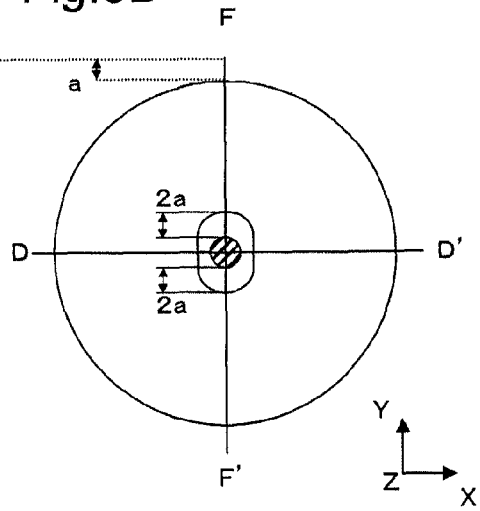

As described above, in the acceleration switch according to the first embodiment, the center of the through hole 305 is shifted from the center of the mass body 301 to the F side by the distance "a", and hence the counter electrode 302 is apparently decentered. A modified example thereof is described below. FIGS. 3C and 3D illustrate the modified example of the first embodiment. Referring to FIGS. 3C and 3D, the difference between the first embodiment and the modified example is clearly described, but the common description of the first embodiment and the modified example is omitted.

The modified example is different from the first embodiment in that the mechanism of decentering the counter electrode 302 is changed. Specifically, as is understood from the comparison between FIG. 3C and FIG. 3A, an acceleration switch of FIG. 3C has a shape in which, under the state where the first substrate to be described later is placed substantially horizontally, the centers of the mass body 301 and the through hole (hole portion) 305 are aligned and coincide with each other, but the centers of the mass body 301 and the through hole (hole portion) 305 do not coincide with and are shifted from the center of the counter electrode (central body) 302 by the distance "a".

Note that, the distances between the counter electrode 302 and the through hole 305 in the respective directions are the same as those in the first embodiment. In FIG. 3C, the distance between the counter electrode 302 and the straight portion 305*a* is the distance "a". In FIG. 3C, the distance between the counter electrode 302 and the arc portion 305*b* is the distance "3*a*" on the F side and the distance "a" on the F' side.

Even in the case where such a modified example is employed, when the substrate of the acceleration switch 003 is turned upright with respect to the horizontal plane, the counter electrode 302 and the through hole 305 are prevented from contacting with each other in the Y direction, and the acceleration switch 003 can maintain a sensitivity of 2 G in the Y direction and a sensitivity of 1 G in the X direction of FIG. 3D. Note that, FIG. 3D illustrates the state of the acceleration switch 003 where all the centers of the mass body 301, the through hole 305, and the counter electrode 302 are aligned with one another.

(Second Embodiment)

Figure 4A:
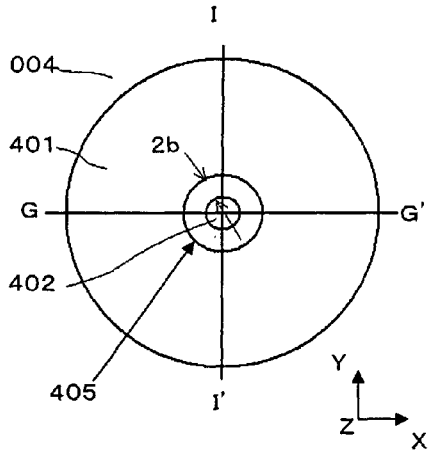
Fig.4A PRIOR ART
FIGS. 4A and 4B are front views illustrating an operation of a conventionally known acceleration switch.
Figure 4B:
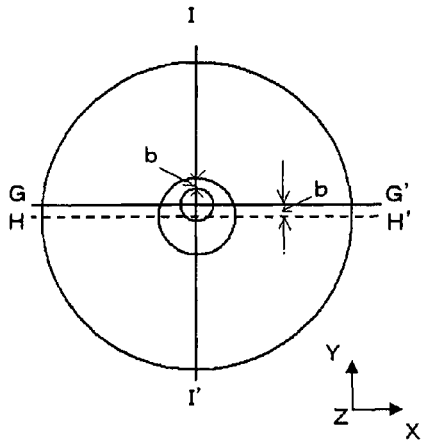
Fig.4B PRIOR ART

Next, a description is given of the case of an acceleration switch having a sensitivity of more than 1 G. FIGS. 4A and 4B illustrate an acceleration switch 004 having a sensitivity of, for example, 2 G. In FIGS. 4A and 4B, the line GG' represents a center line of a counter electrode 402 in the X direction (second direction), the line HH' represents a center line of a mass body 401 in the X direction, and the line II' represents center lines of the counter electrode 402 and the mass body 401 in the Y direction (first direction). In FIG. 4A, the horizontal plane is the XY plane, and the direction of gravity (vertical direction) is the Z direction. In FIG. 4B, the horizontal plane is the XZ plane, and the direction of gravity is the Y direction. Note that, in FIG. 4A, the line GG' and the line HH' are aligned with each other.

FIG. 4A illustrates the case where the acceleration switch 004 is placed horizontally. A distance "2*b*" between the counter electrode 402 and an electrode of the mass body 401 is equal to a distance by which the mass body 401 displaces when an acceleration of 2 G is applied to the acceleration switch 004. Note that, a gap between the counter electrode 402 and the mass body 401 is uniformly the same as the distance "2*b*" on the whole circumference. Symbol "b" as used herein is a distance by which the mass body 401 displaces in response to the acceleration of 1 G.

In this case, when the acceleration switch 004 is turned upright with respect to the horizontal plane, the mass body 401 displaces in the direction of gravity (vertical direction) in response to the gravity of 1 G. For example, as illustrated in FIG. 4B, the counter electrode 402 becomes closer to a side wall of a through hole (hole portion) 405 on the I side, with the Y direction being the direction of gravity (vertical direction). Accordingly, a distance between an electrode of the mass body 401 and the counter electrode 402 is changed from "2*b*" to "b", with the result that the sensitivity in the longitudinal direction (on the I side, the upward direction of gravity, the upward vertical direction) becomes 1 G. In this case, the acceleration switch 004 is designed so as to be switched ON or OFF when an acceleration of 2 G is applied, and hence it is difficult to realize a desired operation satisfactorily.

In view of this, the following second embodiment of the present invention discusses a configuration of an acceleration switch which is designed so that the counter electrode may have an offset amount "b" in the downward direction of gravity (downward vertical direction), and the center of the counter electrode becomes closer to the mass body by the offset amount "b" with respect to the center of the through hole under the state where the acceleration switch is held horizontally.

Figure 5A:
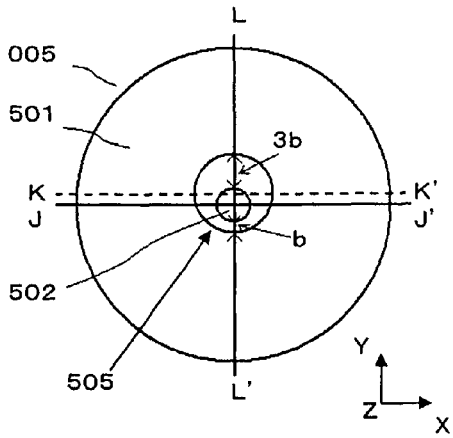
FIGS. 5A and 5B are front views illustrating an operation of an acceleration switch according to a second embodiment of the present invention.
Figure 5B:
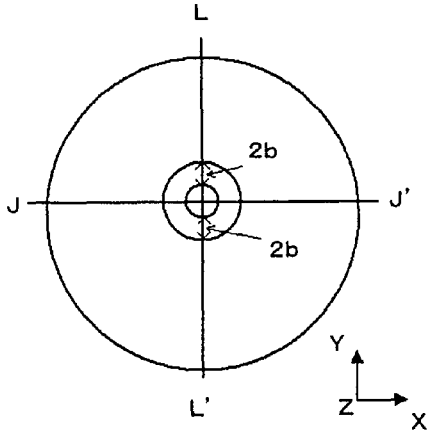

The details of the second embodiment of the present invention are described below with reference to FIGS. 5A and 5B. In FIGS. 5A and 5B, the line JJ' represents a center line of a counter electrode 502 in the X direction (second direction), the line KK' represents a center line of a mass body 501 in the X direction, and the line LL' represents center lines of the counter electrode 502 and the mass body 501 in the Y direction (first direction). In FIG. 5A, the horizontal plane is the XY plane, and the direction of gravity (vertical direction) is the Z direction. In FIG. 5B, the horizontal plane is the XZ plane, and the direction of gravity is the Y direction. Note that, in FIG. 5B, the line JJ' and the line KK' are aligned with each other. FIG. 5A illustrates the case where an acceleration switch 005 as a target of this embodiment is placed horizontally. A space between the mass body 501 and the counter electrode 502 is shifted by 1 G, and hence a distance between the counter electrode 502 and the mass body 501 on the L side is the distance "3*b*", and a distance therebetween on the L' side is the distance "b".

In this case, when the acceleration switch 005 is turned upright with respect to the horizontal plane, the distance between the mass body and the counter electrode is reduced by 1 G in the L direction to be "2*b*". This state is illustrated in FIG. 5B. In this manner, a predetermined sensitivity of 2 G can be maintained even when the acceleration switch is turned upright with respect to the horizontal plane. Note that, in this case, the distance between the counter electrode 502 and the mass body 501 is uniformly the same as the distance "2*b*" on the whole circumference.

In this manner, in the second embodiment, as described in the modified example of the first embodiment, the acceleration switch of FIG. 5A has a shape in which, under the state where the first substrate to be described later is placed substantially horizontally, the centers of the mass body 501 and the through hole (hole portion) 505 are aligned with each other, but the centers of the mass body 501 and the through hole (hole portion) 505 are shifted from the center of the counter electrode (central body) 502 by the distance "b".

(Third Embodiment)

Next, a description is given of the case of offsetting the position of the counter electrode instead of offsetting the position of the mass body. In a third embodiment of the present invention, as a modified example of the second embodiment, the offset amount can be provided as appropriate similarly to the first embodiment. Specifically, an acceleration switch in this embodiment has a shape in which, under the state where the first substrate to be described later is placed substantially horizontally, the centers of a mass body 601 and a counter electrode 602 are aligned with each other, but the centers of the mass body 601 and the counter electrode (central body) 602 are shifted from the center of a through hole (hole portion) 605 by the distance "b".

Figure 6A:
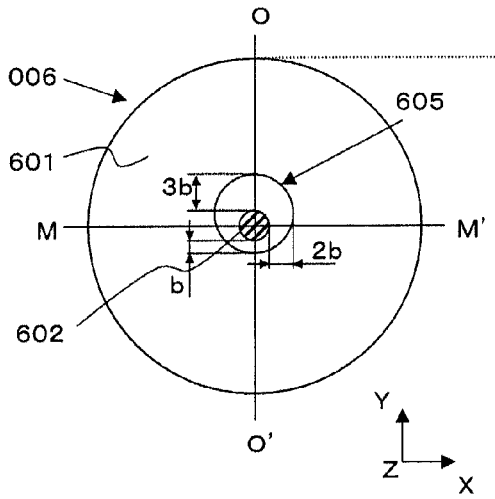
FIGS. 6A and 6B are front views illustrating an operation of an acceleration switch according to a third embodiment of the present invention.
Figure 6B:
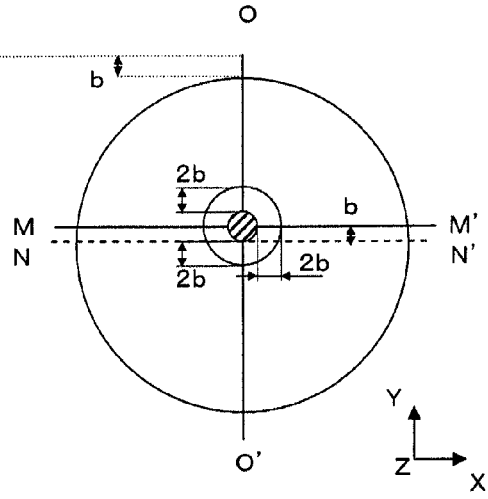

This state is illustrated in FIGS. 6A and 6B. In FIGS. 6A and 6B, the line MM' represents a center line of the counter electrode 602 in the X direction (second direction), the line NN' represents a center line of the mass body 601 in the X direction, and the line OO' represents center lines of the counter electrode 602 and the mass body 601 in the Y direction (first direction). In FIG. 6A, the horizontal plane is the XY plane, and the direction of gravity (vertical direction) is the Z direction. In FIG. 6B, the horizontal plane is the XZ plane, and the direction of gravity is the Y direction. Note that, in FIG. 6B, the line MM' and the line NN' are aligned with each other.

In this manner, when an acceleration switch 006 in this embodiment is turned upright with respect to the horizontal plane, the mass body displaces by the distance "b" in response to the gravity of 1 G, and the distance between the mass body and the counter electrode can be maintained to "2*b*". This state is illustrated in FIG. 6B. Note that, in this case, the distance between the counter electrode 602 and the mass body 601 is uniformly the same as the distance "2*b*" on the whole circumference.

(Fourth Embodiment)

Figure 7A:
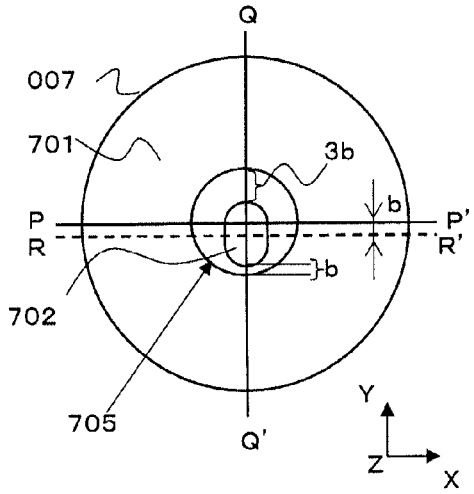
FIGS. 7A and 7B are front views illustrating an operation of an acceleration switch according to a fourth embodiment of the present invention.
Figure 7B:
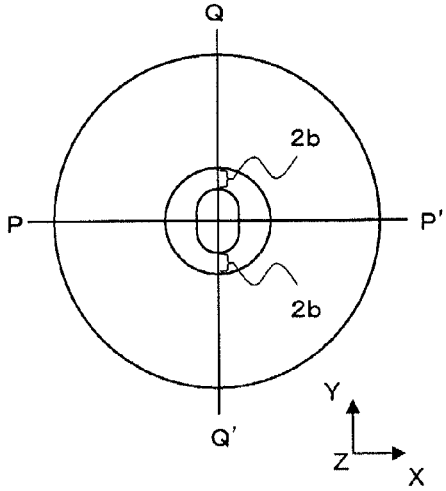

Next, a description is given of the case of changing the shape of the counter electrode. FIGS. 7A and 7B illustrate another method for maintaining a sensitivity of 2 G in the longitudinal direction even when an acceleration switch is turned upright with respect to the horizontal plane. In FIGS. 7A and 7B, the line PP' represents a center line of a mass body 701 in the X direction (second direction), the line RR' represents a center line of a counter electrode 702 in the X direction, and the line QQ' represents center lines of the counter electrode 702 and the mass body 701 in the Y direction (first direction). In FIG. 7A, the horizontal plane is the XY plane, and the direction of gravity (vertical direction) is the Z direction. In FIG. 7B, the horizontal plane is the XZ plane, and the direction of gravity is the Y direction. Note that, in FIG. 7B, the line PP' and the line RR' are aligned with each other.

The shape of the counter electrode is changed so as to have the distance "3*b*" between the counter electrode 702 and a wall surface of a through hole 705 of the mass body 701 on the Q side and have the distance "b" between the counter electrode 702 and a wall surface of the through hole 705 of the mass body 701 on the Q' side. This state is illustrated in FIG. 7A.

When this acceleration switch 007 is turned upright with respect to the horizontal plane, the mass body 701 displaces by 1 G, and hence the distance "2*b*" can be obtained both in the upward and downward longitudinal directions. Thus, a sensitivity of 2 G can be maintained in the longitudinal direction. This state is illustrated in FIG. 7B.

As described above, according to the present invention, a predetermined acceleration can be detected even when a load other than an acceleration intended to be detected, such as the gravity acceleration, is applied. In particular, by recognizing in advance which direction the acceleration switch will be supported with respect to the direction of gravity (vertical direction), the detection of acceleration in any direction can be dealt with in design as in the above-mentioned first to fourth embodiments. Note that, it is assumed in those embodiments that the up-down direction or sheet direction of the drawings is the direction of gravity (vertical direction) for convenience sake, but the present invention is not limited to the embodiments illustrated in the drawings.

Note that, the acceleration switch of the present invention described above is effective not only for the example described above alone but also for a combination of the examples. Further, in the case where the acceleration switch is placed horizontally for use, the acceleration switch of the present invention is effective as an acceleration switch for obtaining different sensitivities depending on directions. Such an acceleration switch can be supported to a desired device in accordance with the directivity of vibration or acceleration recognizable in advance, for example, in the case where the frequency of application of vibration or acceleration differs depending on directions.

In particular, the embodiments of the present invention have discussed the case where the position of the mass body of the acceleration switch moves when the mass body is affected by the gravity acceleration as compared to the state where the mass body is not affected by the gravity acceleration. An electronic device including an acceleration switch often vibrates in the vertical direction, which is the direction of gravity acceleration. Therefore, as illustrated in FIGS. 3B, 5B, 6B, and 7B regarding the vertical direction, the acceleration switch is configured so that the distance between the counter electrode and the through hole may be uniform both in the positive and negative Y directions even in such a case. In this manner, the acceleration switch can have the same sensitivity both in the positive and negative vertical directions of the electronic device with respect to a uniform external vibration in the vertical direction.

Now, the configuration of the acceleration switch is described below with reference to FIGS. 1 and 8. First, a second substrate of the acceleration switch 001 includes a substrate peripheral portion (frame) 101, a beam 102, a mass body 103, and a counter electrode 104 in this order from the outside to the inside of FIG. 1. A distance between a side surface of a hole portion of the mass body 103 and a side surface of the counter electrode is 1 μm or more and 20 μm or less.

The substrate peripheral portion or frame 101 except for a bonding portion with the beam 102 to be described later has an inner circumferential shape (substrate inner surface 101*a*) obtained by hollowing out substantially the center in FIG. 1 into a cylindrical shape. The substrate peripheral portion 101 is sandwiched by a first substrate 105 and a third substrate 106 of FIG. 8 from the upper side and the lower side of FIG. 8. The first substrate 105 and the third substrate 106 are formed of an insulating material. How to sandwich the substrate peripheral portion 101 is not particularly limited, but in this embodiment, the substrate peripheral portion 101 is sandwiched by the first substrate 105 and the third substrate 106 over the full width of the shaded region of the substrate peripheral portion 101 illustrated in FIG. 1.

Figure 1:
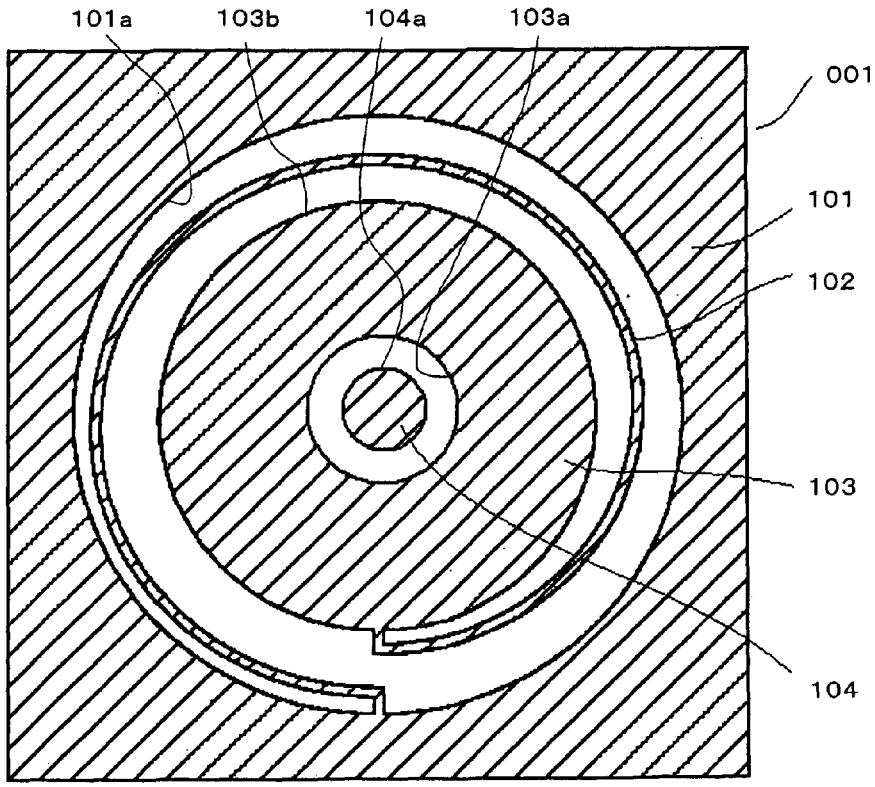
Fig.1 PRIOR ART
FIG. 1 is a schematic front view of a conventionally known acceleration switch.

The mass body 103 is formed into a ring shape (tubular shape) having a mass body inner surface 103*a* and a mass body outer surface 103*b* illustrated in FIG. 1, and is positioned inside the substrate inner surface 101*a* of the substrate peripheral portion 101 hollowed out into the cylindrical shape. In addition, the mass body 103 is not in contact with the first substrate 105 and the third substrate 106 illustrated in FIG. 8 but is positioned between the first substrate 105 and the third substrate 106 via air gaps.

The beam 102 connects the substrate peripheral portion 101 and the mass body 103 to each other. The beam 102 is elastic and is formed so as to substantially go around inside a gap between the substrate peripheral portion 101 and the mass body 103. Specifically, one end of the beam 102 is connected to the substrate peripheral portion 101 at the substrate inner surface 101*a* on the lower side of FIG. 1, and the other end of the beam 102 is connected to the mass body 103 at the mass body outer surface 103*b* on the lower side of FIG. 1. In addition, similarly to the mass body 103, the beam 102 is not in contact with the first substrate 105 and the third substrate 106 illustrated in FIG. 8 but is positioned between the first substrate 105 and the third substrate 106 via air gaps. Note that, the top surface of the beam 102 in FIG. 8 is flush with the top surface of the mass body 103, but the top surface of the beam 102 may be flush with a connection surface between the substrate peripheral portion 101 and the first substrate 105. The beam 102 in FIG. 8 is formed so that the vertical width is smaller than the vertical width of the mass body 103.

The counter electrode 104 has a cylindrical shape, and is positioned inside the mass body inner surface 103*a* and at substantially the center of the acceleration switch 001. The center of the counter electrode 104 substantially matches with the centers of the substrate peripheral portion 101 and the mass body 103. In addition, the counter electrode 104 is sandwiched by the first substrate 105 and the third substrate 106 of FIG. 8 from the upper side and the lower side of FIG. 8. Note that, the above-mentioned "thickness direction of the first substrate" is a direction orthogonal to the line SS' of FIG. 8 in plan view.

Figure 8:
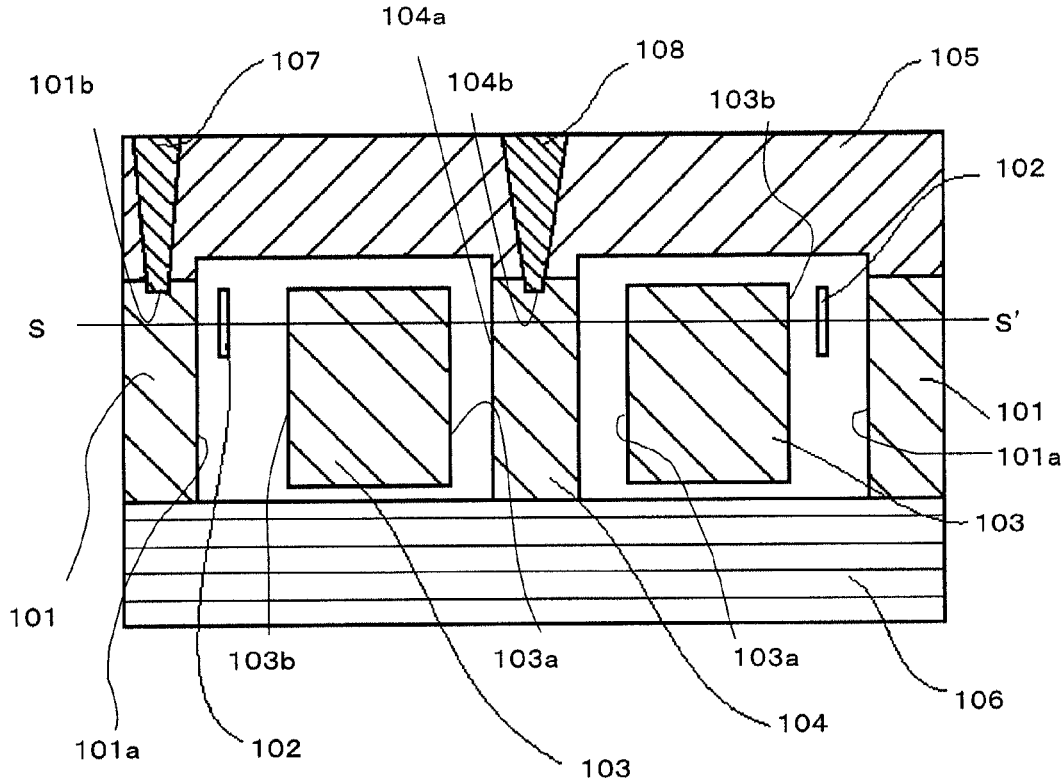
FIG. 8 is a schematic horizontal cross-sectional view illustrating the acceleration switch according to the embodiments of the present invention.

The through electrodes 107 and 108 in this embodiment have a tapered shape or a conical shape in the depth direction from the top surface of the first substrate 105 in FIG. 8. The through electrodes 107 and 108 are not in contact with each other, and are formed to pass through the first substrate 105 to the depths reaching the substrate peripheral portion 101 and the counter electrode 104 of FIG. 8, respectively. In order to reliably connect the through electrodes 107 and 108 to the substrate peripheral portion 101 and the counter electrode 104, concave portions 101*b* and 104*b* are formed in the substrate peripheral portion 101 and the counter electrode 104, respectively, so that the distal ends of the through electrodes 107 and 108 may enter the concave portions 101*b* and 104*b*. Note that, the purpose of the through electrodes is to establish electrical conduction of the substrate peripheral portion 101 and the counter electrode 104, respectively, and hence the shape is not limited as long as the through electrodes are in contact with the substrate peripheral portion 101 and the counter electrode 104, respectively.

In this case, the substrate peripheral portion 101 and the counter electrode 104 are sandwiched by the first substrate 105 and the third substrate 106 illustrated in FIG. 8. As described above, the first substrate 105 and the third substrate 106 are formed of an insulating material, and hence electrical conduction between the substrate peripheral portion 101 and the counter electrode 104 is not established.

Note that, in this embodiment, the surface at which the first substrate 105 and the substrate peripheral portion 101 are in contact with each other and the surface at which the first substrate 105 and the counter electrode 104 are in contact with each other are formed so as to protrude toward the substrate peripheral portion 101 side and the counter electrode 104 side, respectively. This is for the purpose of providing air gaps between the above-mentioned beam 102 and mass body 103 and the first substrate 105 with ease. Therefore, on the surface at which the third substrate 106 and the substrate peripheral portion 101 are in contact with each other and the surface at which the third substrate 106 and the counter electrode 104 are in contact with each other, the third substrate 106 maybe formed so as to protrude toward the substrate peripheral portion 101 side and the counter electrode 104 side.

In this case, when acceleration is applied, the overall acceleration switch 001 moves, but the mass body 103 supported by the beam 102 does not move, and hence the counter electrode 104 provided in the space inside the mass body is brought into contact with the mass body 103. As a result, the electrical conduction is established from the counter electrode 104 via the mass body 103, the beam 102, the substrate peripheral portion 101, and the through electrode 107 to an external contact. The counter electrode 104 is also connected to an external contact via the other through electrode 108. Note that, the distance between the side surface of the through hole (hole portion) of the mass body 103 and the side surface of the counter electrode 104 (central body) is 1 μm or more and 20 μm or less.

In this manner, this acceleration switch is turned ON (the state where electrical conduction between the through electrodes 107 and 108 is established) when the level of vibration becomes a certain value or more, and is turned OFF (the state where electrical conduction between the through electrodes 107 and 108 is not established) when the level of vibration becomes less than the certain value.

What is claimed is:

1. An acceleration switch, comprising:

a first substrate made of an insulating material;

a frame fixed to the first substrate;

a beam positioned inside the frame and supported by the frame;

a mass body supported by the beam and having a hole portion at substantially a center thereof; and a central body positioned inside the hole portion and fixed to the first substrate, wherein a center of the mass body and a center of the central body coincide, and a center of the hole portion does not coincide with the center of the mass body and the center of the central body, when the first substrate is placed substantially horizontal.

2. An acceleration switch according to claim 1, further comprising a second substrate which is positioned on an opposite side of the first substrate and is made of an insulating material, the frame and the central body being fixed to the second substrate.

3. An acceleration switch according to claim 2, wherein the second substrate has a first through electrode for electrically connecting the frame and an external circuit to each other, and a second through electrode for electrically connecting the central body and the external circuit to each other.

4. An acceleration switch according to claim 1, wherein the beam comprises a single beam.

5. An acceleration switch according to claim 1, wherein the beam has an arc-shape configuration.

6. An acceleration switch according to claim 1, wherein a distance between a side surface of the hole portion and a side surface of the central body is 1 μm or more and 20 μm or less when the substrate is placed substantially horizontal.

7. An acceleration switch according to claim 1, wherein the hole portion has two opposed straight portions interconnected at opposite ends by two opposed arc portions.

8. An electronic device, comprising:

the acceleration switch according to claim 1; and a circuit for detecting a detection signal output from the acceleration switch to perform a predetermined operation in accordance with the detection signal.

9. An acceleration switch, comprising:

a first substrate made of an insulating material;

a frame fixed to the first substrate;

a beam positioned inside the frame and supported by the frame;

a mass body supported by the beam and having a hole portion at substantially a center thereof; and a central body positioned inside the hole portion and fixed to the first substrate, wherein a center of the mass body and a center of the hole portion coincide, and a center of the central body does not coincide with the center of the mass body and the center of the hole portion, when the first substrate is placed substantially horizontal.

10. An acceleration switch according to claim 9, further comprising a second substrate which is positioned on an opposite side of the first substrate and is made of an insulating material, the frame and the central body being fixed to the second substrate.

11. An acceleration switch according to claim 10, wherein the second substrate has a first through electrode for electrically connecting the frame and an external circuit to each other, and a second through electrode for electrically connecting the central body and the external circuit to each other.

12. An acceleration switch according to claim 9, wherein the beam comprises a single beam.

13. An acceleration switch according to claim 9, wherein the beam has an arc-shape configuration.

14. An acceleration switch according to claim 9, wherein a distance between a side surface of the hole portion and a side surface of the central body is 1 μm or more and 20 μm or less when the substrate is placed substantially horizontal.

15. An acceleration switch according to claim 9, wherein the hole portion has two opposed straight portions interconnected at opposite ends by two opposed arc portions.

16. An electronic device, comprising:

the acceleration switch according to claim 9; and a circuit for detecting a detection signal output from the acceleration switch to perform a predetermined operation in accordance with the detection signal.

17. An acceleration switch, comprising:

a first substrate made of an insulating material;

a frame fixed to the first substrate;

a beam positioned inside the frame and supported by the frame;

a mass body supported by the beam and having a hole portion at substantially a center thereof; and a central body positioned inside the hole portion and fixed to the first substrate, wherein a center of the central body and a center of the hole portion coincide when a predetermined acceleration other than gravity acceleration is applied to the acceleration switch.

18. An acceleration switch according to claim 17, wherein a distance between a side surface of the hole portion and a side surface of the central body is 1 μm or more and 20 μm or less when the substrate is placed substantially horizontal.

19. An acceleration switch according to claim 17, wherein the hole portion has two opposed straight portions interconnected at opposite ends by two opposed arc portions.

20. An electronic device, comprising:

the acceleration switch according to claim 17; and a circuit for detecting a detection signal output from the acceleration switch to perform a predetermined operation in accordance with the detection signal.

* * * * *